US005134751A

United States Patent [19]

Reed, Jr. et al.

[11] Patent Number: 5,134,751

[45] Date of Patent: Aug. 4, 1992

[54] HAND-HELD VACUUM CLEANER

[75] Inventors: Charles A. Reed, Jr., Shelton; Charles Z. Krasznai, Trumbull; Richard B. Kosten, West Haven; Robert Osit, Shelton, all of Conn.

[73] Assignee: Black & Decker Inc., Newark, Del.

[21] Appl. No.: 637,413

[22] Filed: Jan. 4, 1991

[51] Int. Cl.[5] ..... A47L 5/24

[52] U.S. Cl. ..... 15/344; 15/347; 55/376; 55/378

[58] Field of Search ..... 15/347, 344, 350, 351; 55/374, 376, 378

[56] References Cited

U.S. PATENT DOCUMENTS

| | | | |
|---|---|---|---|
| 1,605,806 | 11/1926 | Briggs et al. | 55/378 X |
| 2,580,630 | 1/1952 | White | 55/374 |
| 2,780,828 | 2/1957 | Brace | 55/374 X |
| 3,213,600 | 10/1965 | Anderson | 55/378 X |
| 3,387,346 | 6/1968 | Hasenbank | 55/374 X |
| 4,791,699 | 12/1988 | Sovis et al. | 55/374 X |

*Primary Examiner*—Chris K. Moore
*Attorney, Agent, or Firm*—Barry E. Deutsch

[57] ABSTRACT

A hand-held vacuum cleaner including a housing having mating first and second half housing elements. The housing has a handle and a nozzle. A motor is mounted within the housing for driving a shaft. A fan is mounted on the shaft for rotation therewith. A selectively separable bag assembly is mounted on the housing. A working air channel is defined within the housing communicating the nozzle with the bag assembly. The bag assembly includes a collar, a dirty air collector bag attached to the collar, and a combination latch and handle member pivotally connected to the collar. The housing includes a wall member for receiving the collar of the bag assembly and a detent member for holding the latch and handle member in a locking position when the member is pivoted into engagement therewith for securing the bag assembly onto the wall member of the housing.

9 Claims, 4 Drawing Sheets

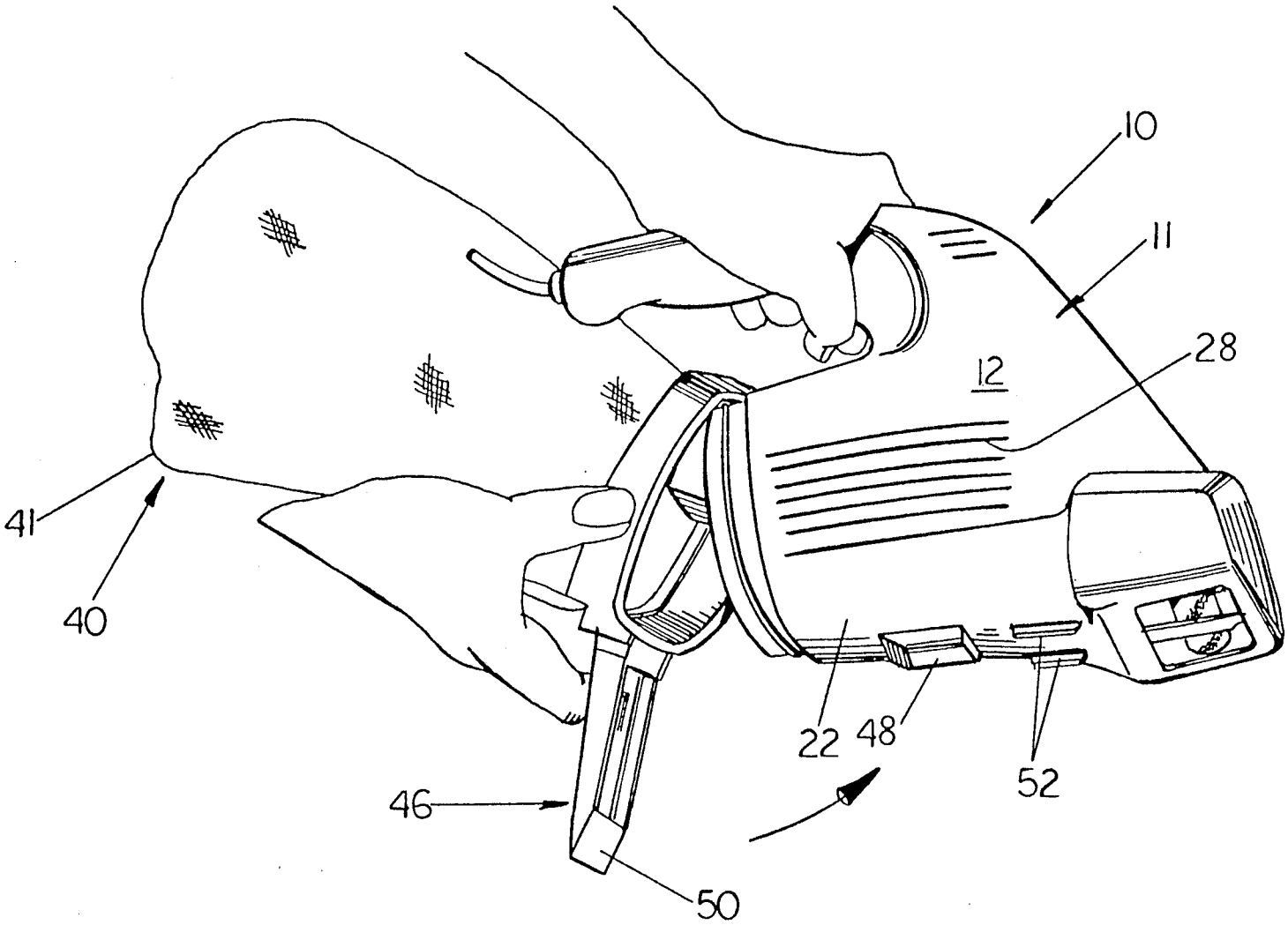
10
11
28
12
52
48
22
50
46
40
41

FIG.4
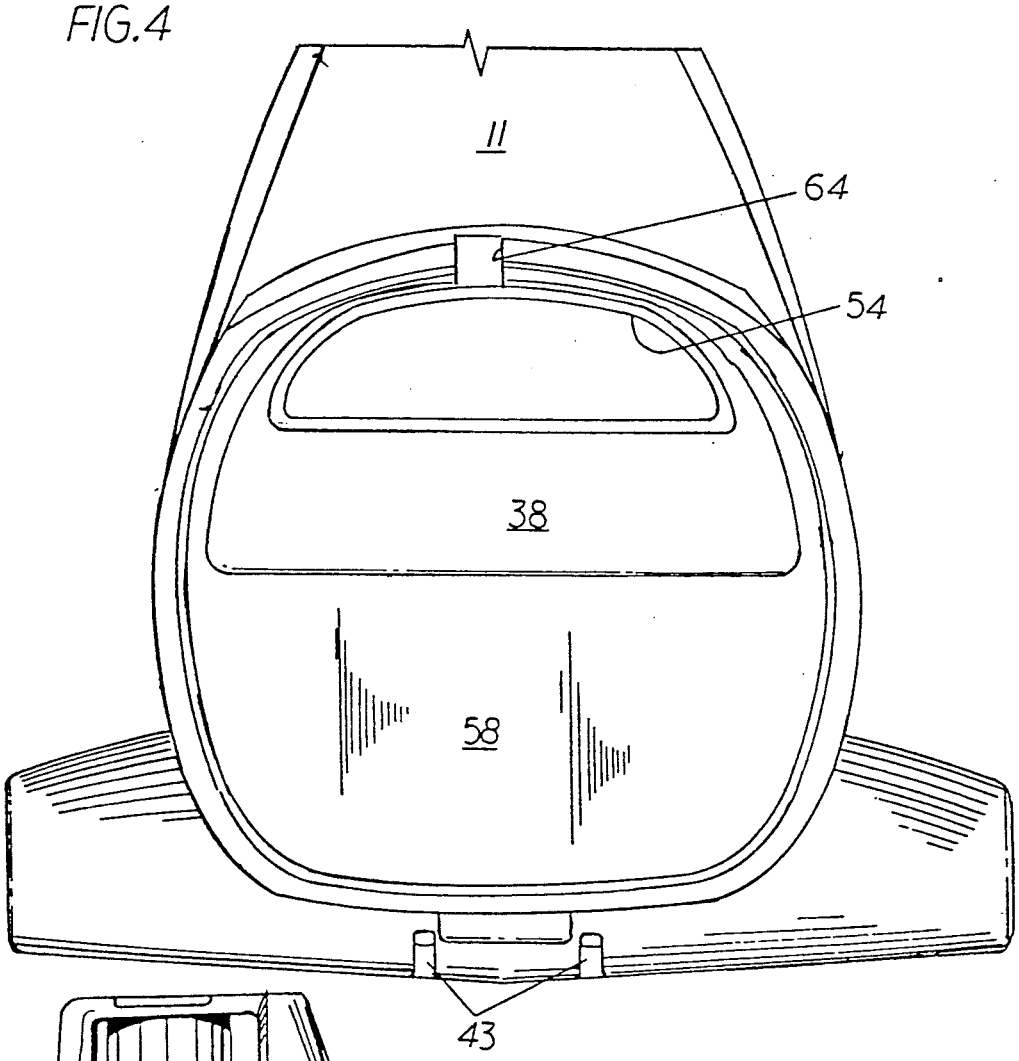
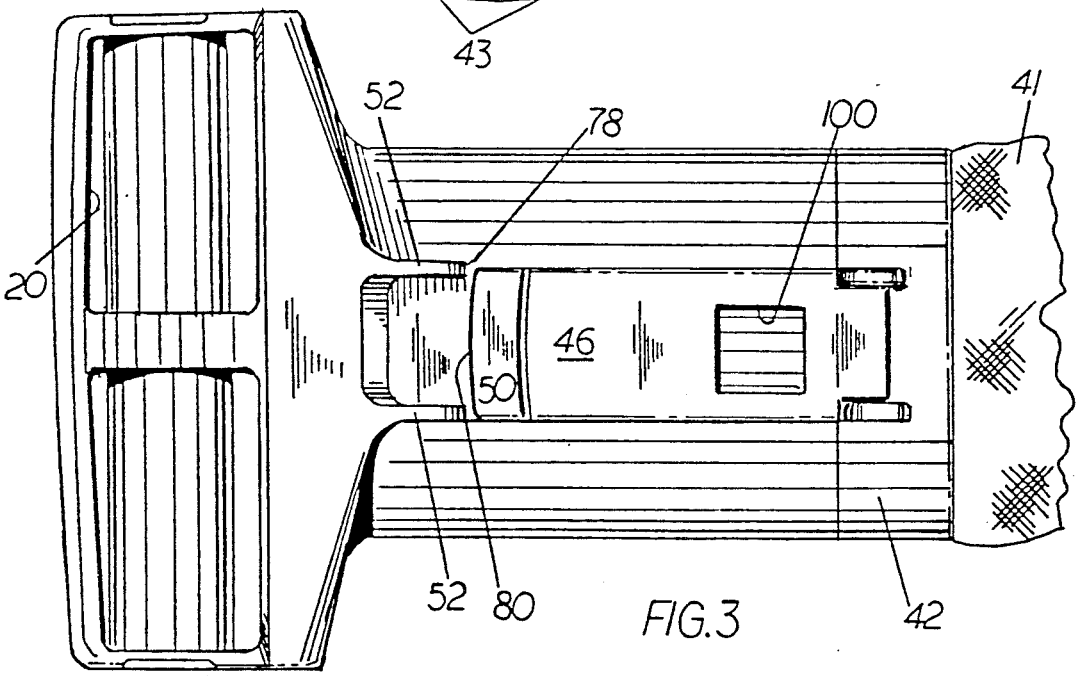
FIG.3

HAND-HELD VACUUM CLEANER

BACKGROUND OF THE INVENTION

This invention relates to hand-held vacuum cleaners and in particular to a hand-held vacuum cleaner having a selectively separable bag assembly that is effectively engaged in sealing relationship to the housing of the cleaner.

AC powered hand-held vacuum cleaners have become increasingly popular in the past several years. Such cleaners ar particularly useful where conventional larger size vacuum cleaners such as large canister or upright types are inconvenient for the user. Such hand-held vacuum cleaners are particularly useful in cleaning stairs and furniture. Examples of these AC powered hand-held vacuum cleaners are found in U.S. Pat. Nos. 4,700,428 and 4,891,861.

Hand-held vacuum cleaners of the type described typically employ a removable bag assembly for collecting the dirt drawn into the cleaner with the working air. Such bag assemblies must be periodically removed from the housing of the vacuum cleaner to allow the user to clean the dirt from the dirty air collector bag of the bag assembly. A failure to routinely clean the dirt from the dirty air collector bag reduces the operating performance of the cleaner and may result in clogging of the working air flow channels of the cleaner.

To encourage routine cleaning of the bag assembly, the bag assembly should be designed so that it is easily removed from the vacuum cleaner's housing and also easily replaced thereon. Furthermore, any seals employed between the bag assembly and the housing should be extremely effective to prevent dirt entrained air from bypassing the dirty air collector bag.

Accordingly, it is an object of this invention to provide a hand-held vacuum cleaner having a selectively removable bag assembly which can be readily removed from the cleaner, cleaned, and replaced thereon without creating any significant discomfiture to the user of the cleaner.

SUMMARY OF THE INVENTION

The foregoing object and other objects of the invention are attained in a hand-held vacuum cleaner including a housing comprising mating first and second half housing elements. The housing has a handle and nozzle. A motor is mounted within the housing for driving a shaft. A fan is mounted on the shaft for rotation therewith. A selectively separable bag assembly is mounted on the housing. Means define a working air channel within the housing communicating the nozzle with the bag assembly. The bag assembly includes a collar, a dirty air collector bag attached to the collar and a combination latch and handle member pivotally connected to the collar. The housing includes a wall member for receiving the collar of the bag assembly and a detent member for holding the latch and handle member in a locked position when the member is pivoted into engagement therewith for securing the bag assembly onto the wall member of the housing.

BRIEF DESCRIPTION OF THE DRAWING

FIG. 2 is a perspective view of a hand-held vacuum cleaner having the bag assembly being placed thereon;

FIG. 3 is a bottom plan view of a portion of the vacuum cleaner shown in FIG. 1 illustrating further details of the present invention;

FIG. 4 is an elevational view taken from the end of the vacuum cleaner;

DESCRIPTION OF THE PREFERRED EMBODIMENT

Figure 1:
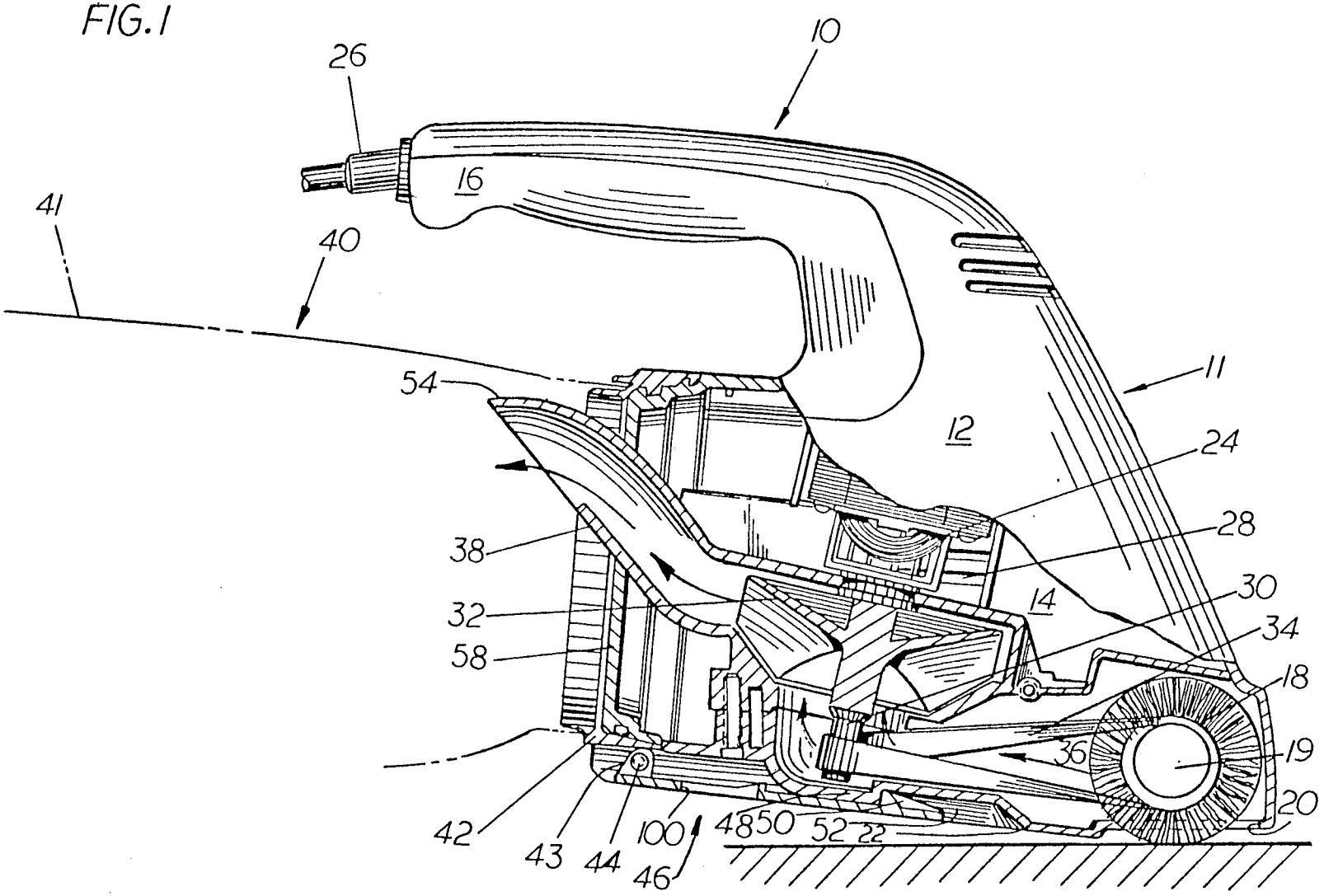
FIG. 1 is a side view, partially in cross section, of a hand-held vacuum cleaner embodying the present invention.

Referring now to the various figures of the drawing, there is disclosed a hand-held vacuum cleaner generally designated by the reference numeral 10. In referring to the various figures, like numerals shall refer to like parts. Vacuum cleaner 10 comprises a housing generally designated by reference numeral 11. The housing has two mating half elements 12, 14 which are joined together via a tongue and groove joint. A handle 16 extends outwardly from the top of housing 11. Housing 11 includes a member 22 defining the lower wall of cleaner 10. Member 22 is removably connected to first and second half housing elements 12, 14. Member 22 has an opening 20 defining the intake nozzle for vacuum cleaner 10. A rotating brush 18 is mounted within the nozzle. Brush 18 includes a spindle 19 which is mounted in opposed bearing housing cavities (not shown) mounted in the side wall of member 22. An endless belt 34 is wrapped around spindle 19 for rotationally driving brush 18.

A motor 24 is supported between the two half housing elements 12, 14. The motor is mounted in a vertical orientation with respect to the floor on which the vacuum cleaner 10 is supported. Motor 24 is operated by a source of AC power. Motor 24 is connected to the source of power via AC power plug 26. Each of the half housing elements includes a plurality of air vents 28 for providing cooling air to and from the motor.

Motor 24 drives a shaft 30 connected thereto. Fan 32 is mounted on shaft 30 for rotation therewith. Shaft 30 also is connected to belt 34 which, as described previously, drives brush 18.

Internal walls of half housing elements 12, 14 define, in part, working air channel 36. Channel 36 commences at nozzle 20 and terminates at an outlet chute 38. Outlet chute 38 extends from back wall 58 of housing 11. Outlet chute 38 directs the working air drawn into the vacuum cleaner into a dirty air bag assembly 40. The upper surface of outlet chute 38 includes a generally arcuate or curved wall 54 for directing the working air towards the rear of the bag. Curved wall 54 deflects any debris entrained within the working air away from the user and enables the velocity of the entrained debris to decrease before the debris hits any surface of the bag. Curved wall 54 facilitates the filling of the bag. It is particularly important to note that outlet chute 38 is positioned at the top of the bag assembly. It has been determined that more dirt can be captured within a given size bag when the chute is positioned at the top of the bag assembly rather than at the bottom thereof.

Bag assembly 40 includes a dirt collector bag 41 which is attached to a collar 42. Bag assembly 40 is removably secured to housing 11. Collar 42 includes a pair of depending spaced bosses 43 which provide support for a pivot pin 44. A combined handle and latch member 46 is pivotally attached to pivot pin 44. Collar 42 has an inwardly extending finger 62 formed on its top surface. Finger 62 mates with an indented section 64 formed in the top of housing 11 so that the collar and attached bag assembly 40 are properly aligned on the housing.

Handle and latch member 46 includes a slightly canted upwardly extending rib 50 provided at its forward end. Rib 50 mates with a detent 48 formed on member 22 to latch the collar and bag assembly onto housing 11. Lower wall 22 further includes a pair of guide ribs 52 for guiding rib 50 on handle and latch member 46 into proper position with respect to detent 48. A more detailed description of the air flow path through the vacuum cleaner is described in co-pending application, Ser. No. 637,412, filed concurrently herewith in the name of Charles A. Reed, Jr. and assigned to the same assignee as the assignee hereof.

Referring specifically to FIGS. 2-6, details of the features of the present invention shall now be described. As previously described, bag assembly 40 includes a dirt collector bag 41 mounted on collar 42. As particularly illustrated in FIG. 6, collar 42 includes first and second radially spaced flanges 66 and 68 forming a space 70 therebetween. Space 70 narrows towards its closed end as defined by wall 72. The free end 74 of collector bag 41 is captured between the two flanges and the bag is then permanently affixed to the flanges as for example by sewing the bag to the inner flange 68.

Collar 42 has combination handle-latch member 46 pivotally attached thereto. Handle-latch member 46 is pivotable between a first position as illustrated in FIG. 2 and a second position as illustrated in FIGS. 1 and 3. In the position illustrated in FIG. 2, the user can grasp member 46 to carry bag assembly 40 when it is desired to empty the bag of the dirt entrapped therein.

Figure 5:
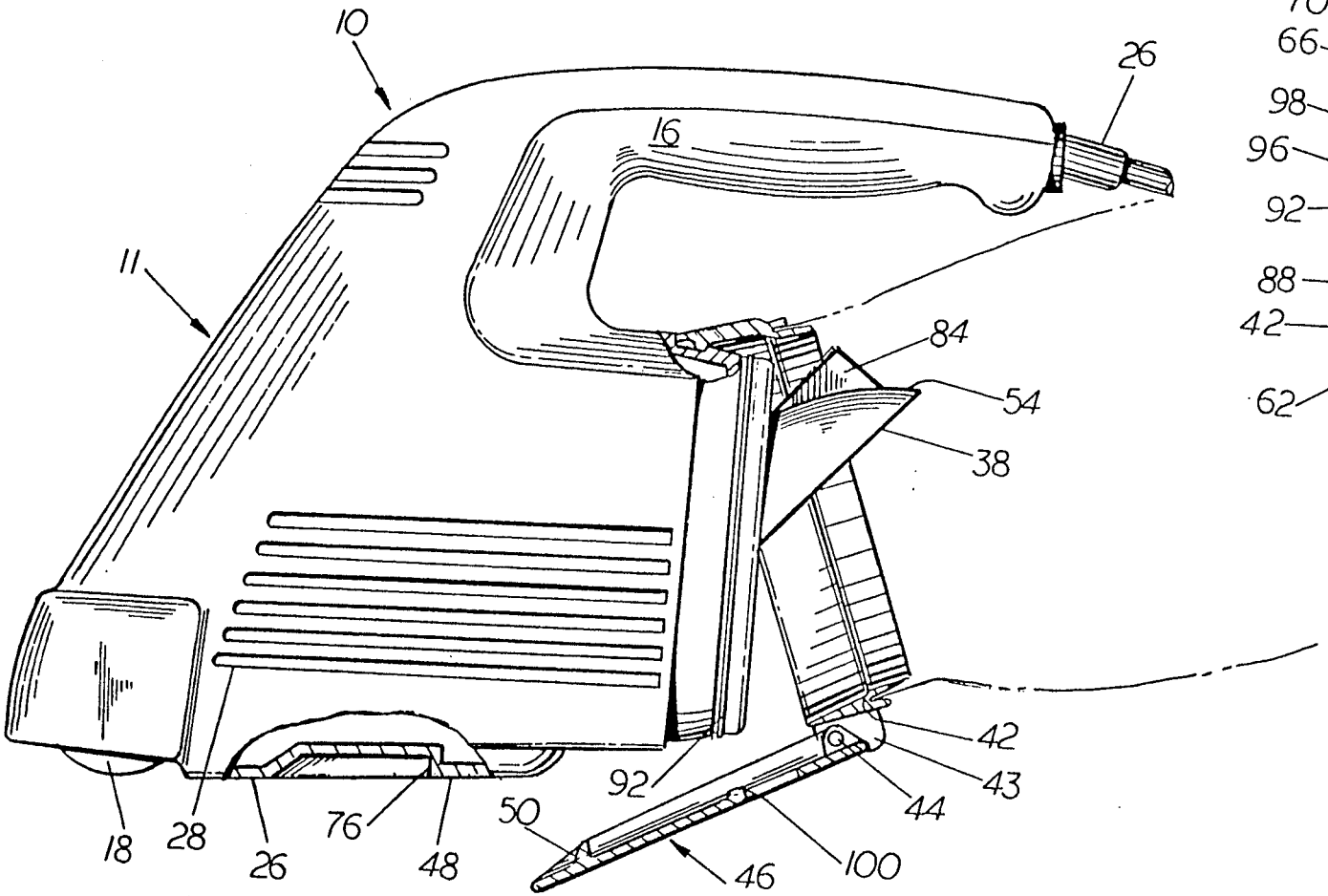
FIG. 5 is a side elevational view of the vacuum cleaner illustrating further details of the invention.

When bag assembly 40 is mounted on housing 11 of vacuum cleaner 10, handle-latch member 46 is pivoted to its second position to latch the bag assembly on the housing. As illustrated in FIGS. 2 AND 5, rib 50 is slightly canted in the direction of pivot pin 44. Rib 50 is intended to mate with detent 48 on housing 11. Detent 48 includes a wall 76 which is canted at the same angle as rib 50. The combination of rib 50 and detent member 48 firmly lock the handle-latch member on lower wall 22 of housing 11.

Figure 6:
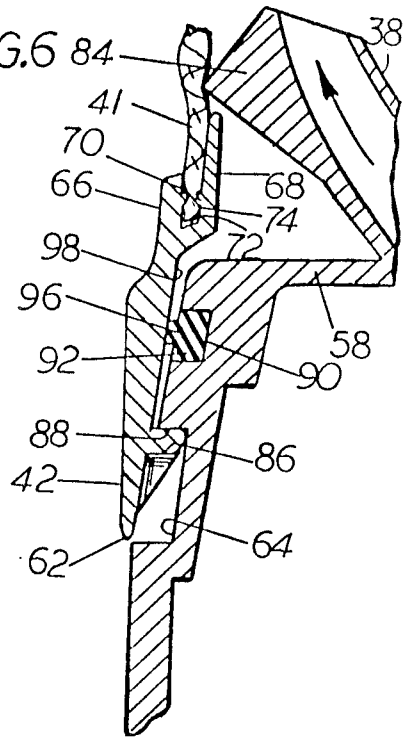
FIG. 6 is an enlarged fragmentary cross sectional view of a portion of the vacuum cleaner shown in FIG. 1 further illustrating the present invention.

As illustrated in FIG. 3, ends 78 of ribs 52 cooperate with end 80 of member 46 to guide member 46 onto detent member 48 and to insure that member 46 is retained in its latched position. Member 46 includes a generally rectangularly shaped opening 100 which functions to enable the user to support bag assembly 40 with the user's finger when removing the bag from the cleaner As illustrated in FIGS. 5 and 6, curved wall 54 of outlet chute 38 has a cam-like member 84 extending upwardly therefrom. As shall be more fully described hereinafter, cam-like member 84 is provided to insure that collar 42 is properly positioned on housing 11 when the bag assembly is mounted on the housing.

As illustrated in FIG. 6, collar 42 includes an axially extending finger 62. Housing 11 includes an indented section 64 which is configured to match the shape of finger 62. Collar 42 further includes a radially inwardly extending wall member 86 which as illustrated in FIG. 6, is intended to engage a rear wall 88 which partially defines indented section 64. The combination of finger 62 and indented section 64 on the collar and housing respectively is provided to accurately locate the collar on the housing.

To place the collar and attached collector bag 41 onto housing 11, the inside top surface of the collar is first placed over outlet chute 38. The top of cam member 84 contacts the inside surface of the collar and provides a force to move the collar forwardly towards back wall 58 so that finger 62 is accurately positioned within indented section 64. In the event that collar 42 is not placed properly over outlet chute 38, cam 84 makes it impossible to latch the bag in place. This insures proper installation of the bag to the unit. The foregoing is illustrated in FIG. 5.

Backwall 58 includes an O-ring groove 90 adjacent outlet chute 38. resilient O-ring 92 is placed within groove 90 to seal the housing with respect to bag assembly 40. 0-ring 92 preferably includes a radially upstanding flexible lip 96 which engages inside surface 98 of collar 42. The flexible lip provides an effective seal between the housing and bag assembly and enables the bag assembly to be easily removed from and placed on the housing.

Vacuum cleaner 10 as described herein includes a bag assembly that is easily removed for cleaning and may be readily replaced onto the housing of the vacuum cleaner once the dirt has been removed from the collector bag. The described latch and sealing arrangement for the bag assembly promotes effective and efficient operation of the vacuum cleaner.

Vacuum cleaner 10 may include an attachment connector for attaching additional elements, such as a hose to the cleaner. A more detailed explanation of the attachment connector is described in co-pending application, Ser. No. 637,414, filed concurrently herewith in the names of Richard B. Kosten, Charles Z. Krasznai and Robert Osit and assigned to the same assignee as the assignee hereof.

While a preferred embodiment of the present invention has been described and illustrated, the invention should not be limited thereto, but may be otherwise embodied within the scope of the following claims.

What is claimed is:

1. A hand-held vacuum cleaner including a housing comprising mating first and second half housing elements, said housing having a handle and a nozzle, a motor mounted within the housing for driving a shaft, a fan mounted on said shaft for rotation therewith, a selectively separable bag assembly mounted on said housing, means defining a working air channel within said housing communicating said nozzle with said bag assembly, said bag assembly including a collar, a dirty air collector bag attached to said collar and a combination latch and handle member pivotally connected to said collar, said housing including a wall member for receiving said collar of said bag assembly and a detent member for holding said latch and handle member in a locked position when the member is pivoted into engagement therewith for securing said bag assembly onto said wall member of said housing.

2. A hand-held vacuum cleaner in accordance with claim 1 wherein said latch and handle member is disengaged from said detent member for removing said bag assembly from said wall member, said latch and handle member being pivoted into a position for grasping by the user of the vacuum cleaner for carrying the bag assembly.

3. A hand-held vacuum cleaner in accordance with claim 2 wherein said collar includes an axially extending finger and said housing includes an indented portion having a complimentary shape to said finger, said finger extending within said indented portion when said collar is positioned on said wall member.

4. A hand-held vacuum cleaner in accordance with claim 3 wherein said wall member includes a radially extending cam member in axial alignment with said indented portion of said housing, the inside surface of said collar contacting said cam member as said collar is placed on said wall member, said cam member providing a force to direct said finger of said collar into said indented portion of said housing.

5. A hand-held vacuum cleaner in accordance with claim 1 wherein said collar includes an axially extending finger and said housing includes an indented portion having a complimentary shape to said finger, said finger extending within said indented portion when said collar is positioned on said wall member.

6. A hand-held vacuum cleaner in accordance with claim 5 wherein said wall member includes a radially extending cam member in axial alignment with said indented portion of said housing, the inside surface of said collar contacting said cam member as said collar is placed on said wall member, said cam member providing a force to direct said finger of said collar into said indented portion of said housing.

7. A hand-held vacuum cleaner in accordance with claim 1, wherein said wall member includes a radially extending cam member, the inside surface of said collar contacting said cam member as said collar is placed on said wall member, said cam member producing a force to accurately position said collar on said wall member.

8. A bag assembly for a hand-held vacuum cleaner comprising a collar, a dirty air collector bag attached to said collar and a combination latch and handle member pivotally connected to said collar, said member being operable in a first position for engaging a detent mechanism on said cleaner for releasably latching said bag assembly on said cleaner and being operable in a second position for grasping by the user of the vacuum cleaner for carrying said bag assembly.

9. A bag assembly in accordance with claim 8 wherein said collar comprises a pair of axially extending and relatively concentric flange-like members, with the space between the opposed surfaces of said flange-like members narrowing in a first direction, said bag being placed over the outer surface of the inner of the flange-like members, with the material defining the open end of the bag extending into said space towards the first direction.

* * * * *